US009680244B1

(12) United States Patent
Dernovsek et al.

(10) Patent No.: US 9,680,244 B1
(45) Date of Patent: Jun. 13, 2017

(54) HEADER APPARATUS FOR PROVIDING ELECTRICAL CONNECTION TO A PRINTED CIRCUIT BOARD, AND DAUGHTER CARD AND CIRCUIT ASSEMBLY INCORPORATING THE HEADER APPARATUS

(71) Applicant: Universal Lighting Technologies, Inc., Madison, AL (US)

(72) Inventors: John J. Dernovsek, Madison, AL (US); Donald Folker, Madison, AL (US); Mike LeBlanc, Huntsville, AL (US)

(73) Assignee: UNIVERSAL LIGHTING TECHNOLOGIES, INC, Madison, AL (US)

( * ) Notice: Subject to any disclaimer, the term of this patent is extended or adjusted under 35 U.S.C. 154(b) by 0 days.

(21) Appl. No.: 14/848,505

(22) Filed: Sep. 9, 2015

Related U.S. Application Data

(60) Provisional application No. 62/047,804, filed on Sep. 9, 2014.

(51) Int. Cl.
*H01R 24/66* (2011.01)
*H01R 12/71* (2011.01)
*H01R 107/00* (2006.01)

(52) U.S. Cl.
CPC ..... *H01R 12/716* (2013.01); *H01R 24/66* (2013.01); *H01R 2107/00* (2013.01)

(58) Field of Classification Search
CPC ..... H01R 24/66; H01R 24/68; H01R 12/716; H01R 21/721; H01R 12/7052; H01R 12/7005; H01R 12/91
USPC ..... 439/65, 633, 637, 325, 59, 64, 60–62; 361/679.31, 679.32
See application file for complete search history.

(56) References Cited

U.S. PATENT DOCUMENTS 3,975,076 A * 8/1976 Shida ..... H01R 13/03 439/567
5,162,979 A * 11/1992 Anzelone ..... G06F 13/409 361/679.32
6,071,756 A * 6/2000 Sines ..... H05K 3/306 257/697
6,305,949 B1 * 10/2001 Okuyama ..... H01R 12/585 439/75
6,442,832 B1 * 9/2002 Noble ..... H01R 43/048 174/261

(Continued)

*Primary Examiner* — Abdullah Riyami
*Assistant Examiner* — Harshad Patel
(74) *Attorney, Agent, or Firm* — Patterson Intellectual Property Law, P.C.; Mark J. Patterson; Grant M. Ford

(57) ABSTRACT

A header apparatus for providing electrical connection between a daughter card and a printed circuit board. The header apparatus may include a body having a base and a backing portion extending outwardly from the base portion. The header apparatus may include at least one pin extending through the base in a direction substantially parallel to the backing portion, and a gap formed between opposing surfaces of the backing portion and the at least one pin. The header apparatus may be configured to receive at least a portion of the daughter card at the gap to connect the header apparatus and the daughter card. The header apparatus may be connected to a daughter card and/or main printed circuit board, and may communicatively couple the daughter card and main printed circuit board.

17 Claims, 5 Drawing Sheets

(56) References Cited

U.S. PATENT DOCUMENTS

| | | | | |
|---|---|---|---|---|
| 8,520,401 | B2 * | 8/2013 | Tian | G06F 1/185<br>361/679.31 |
| 2012/0170261 | A1 * | 7/2012 | Hu | H01R 12/7076<br>362/217.16 |

* cited by examiner

HEADER APPARATUS FOR PROVIDING ELECTRICAL CONNECTION TO A PRINTED CIRCUIT BOARD, AND DAUGHTER CARD AND CIRCUIT ASSEMBLY INCORPORATING THE HEADER APPARATUS

CROSS-REFERENCES TO RELATED APPLICATIONS

This application claims benefit of U.S. Provisional Patent Application No. 62/047,804, dated Sep. 9, 2014, and which is hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates generally to a header apparatus for providing electrical connection to a main printed circuit board, a daughter card connected to a header apparatus, and a circuit assembly including the header apparatus, daughter card, and main printed circuit board.

Traditional header apparatuses are used to form electrical connections between main printed circuit boards and daughter cards. Typically, a header may comprise a plurality of conductive pins, opposing ends of which are connected to through holes located at the main printed circuit board and the daughter card. However, this configuration becomes inefficient when surface mounted components are used on the daughter card. For example, a wave soldering or press fit method may be required for connecting the daughter card and the connector, whereas reflow soldering may be required for attaching surface mounted components to the daughter card.

FIG. 4 illustrates an exemplary configuration of a daughter card 400 and connector 440. A traditional daughter card 400 may comprise a plurality of components 410 connected thereto. The components 410 may be connected to a plurality of through holes 430 via a bus 420. The daughter card 400 may electrically and mechanically connect to a connector 440 at the plurality of through holes 430. The connector 440 comprises daughter card legs 450 and main circuit board legs 460. Daughter card legs 450 of the connector 440 extend into the through holes 430 and are typically soldered at a rear side of the daughter card using wave soldering. Main circuit board legs 460 are configured to extend into through holes associated with a main circuit board and may be soldered using a wave soldering method at a rear surface of the main circuit board in a manner similar to that described in relation to daughter card 400, or may be press fit to the main circuit board.

Although the connector 440 may be secured to a daughter card using wave soldering or press fitting as described above, a second soldering or fitting method must be used to connect surface mounted components to the daughter card 400. Thus, the time, expense, and complexity associated with connecting a daughter card 400, connector 440, and a main circuit board is unnecessarily high in the related art.

What is needed in the art is a header apparatus for providing electrical connection to a printed circuit board which provides reduced manufacturing time, reduced cost, and decreased manufacturing complexity compared to the current method. One solution described herein provides a header designed to permit a single soldering operation associated with both attaching components to a daughter card and connecting the daughter card to the header. Such a header design may greatly decrease the time, expense, and complexity associated with current header designs which require through hole connection for connecting a header and daughter card. Another solution described herein which relates the above-described deficiencies of the existing methods involves permitting pins associated with a header to be press fit within the header rather than being formed as part of the molding process.

BRIEF SUMMARY OF THE INVENTION

One embodiment of the present invention provides a header apparatus for providing electrical connection between a daughter card and a printed circuit board. The header may include a body having a base and a backing portion extending outwardly from the base portion. The header apparatus may include at least one pin extending through the base in a direction substantially parallel to the backing portion, and a gap formed between opposing surfaces of the backing portion and the at least one pin. The header may be configured to receive at least a portion of the daughter card at the gap to connect the header and the daughter card.

Another embodiment of the present invention provides a daughter card having a header connected thereto, the daughter card being configured to connect to a printed circuit board, the daughter card including a header having a body, at least one pin extending through the base in a direction substantially parallel to the backing portion, and a gap. The backing portion may extend outwardly from the base portion. The gap may be formed between opposing surfaces of the backing portion and the at least one pin. The header may be configured to receive at least a portion of the daughter card at the gap to connect the header and the daughter card. The circuit board may include at least one component, a bus, and a connection interface communicatively coupled to the at least one component via the bus, wherein the connection interface is connected to the header.

A further embodiment of the present invention provides A circuit assembly including daughter card having a header connected thereto and a printed circuit board connected to the header, the circuit assembly including a header having a body, at least one pin, and a gap. The body may include a base and a backing portion extending outwardly from the base portion. The at least one pin may extend through the base in a direction substantially parallel to the backing portion. The gap may be formed between opposing surfaces of the backing portion and the at least one pin, wherein the header is configured to receive at least a portion of the daughter card at the gap to connect the header and the daughter card. The daughter card may include at least one component, a bus, and a connection interface communicatively coupled to the at least one component via the bus. The connection interface may be connected to the header. The main printed circuit board (PCB) may include at least one through hole configured to receive at least a portion of the at least one pin. The daughter card and main PCB may be communicatively coupled to one another via the at least one pin.

Numerous other objects, features, and advantages of the present invention will be readily apparent to those skilled in the art upon a reading of the following disclosure when taken in conjunction with the accompanying drawings.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

Figure 1A:
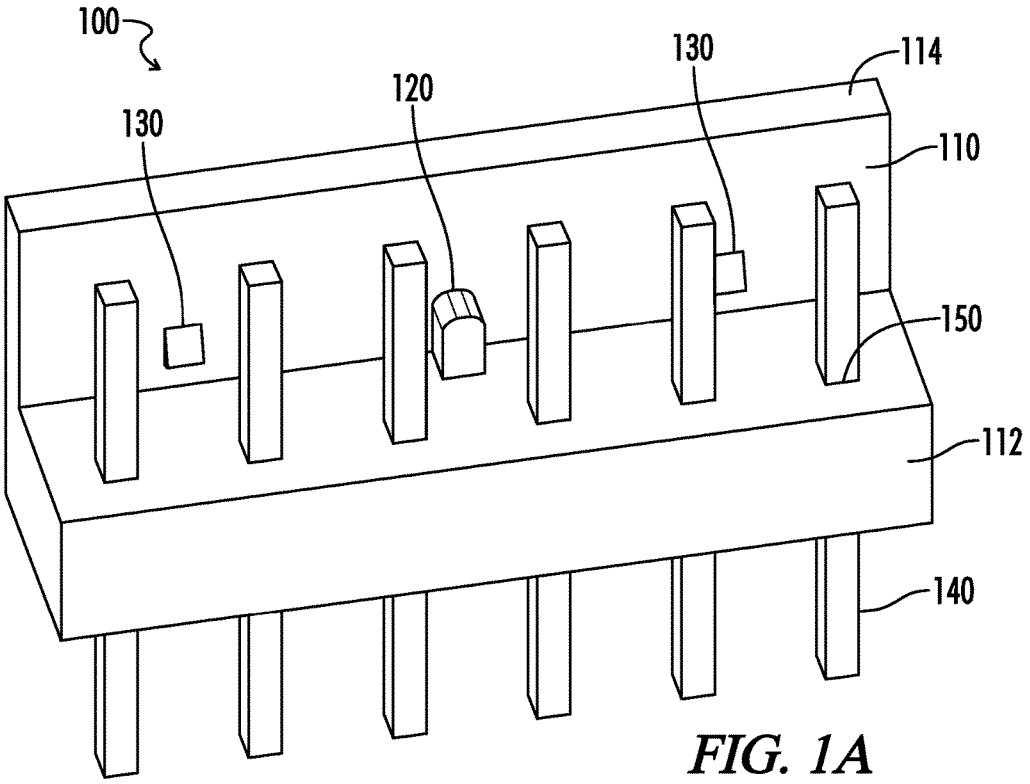
FIGS. 1A-B respectively illustrate a front perspective view and a side view of a header according to an exemplary embodiment.
Figure 1B:
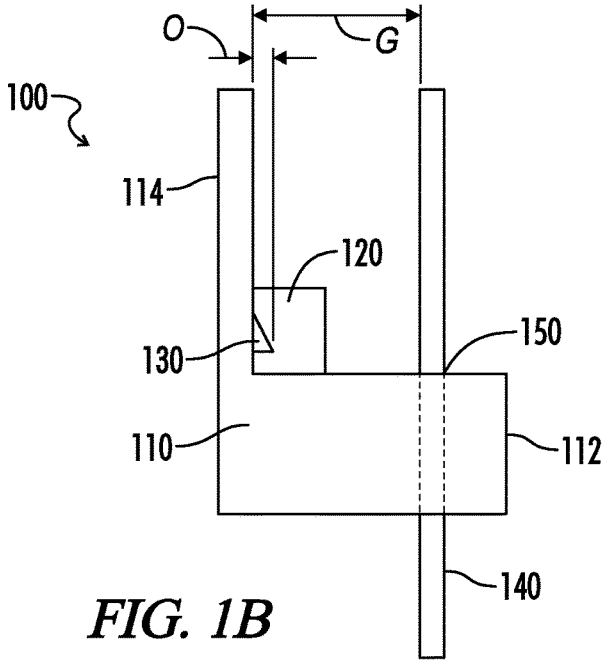

Referring generally to FIGS. 1-3, provided is a header configured to connect to one or more printed circuit boards and/or daughter cards. FIGS. 1A-B respectively illustrate an elevated perspective view and a side view of a header 100 in accordance with an exemplary embodiment. The header 100 may comprise a body 110 having a base 112 and a backing portion 114. In one embodiment, the body 110 of header 100 may be formed of a plastic material. However, the body 110 is not required to be formed of plastic within the scope of the present disclosure, and any material capable of being formed in manner consistent with the disclosure herein may be used without departing from the spirit and the scope of the invention.

The header 100 may further comprise a keying post 120. Keying post 120 may extend outwardly from the body 110 (e.g., at the base 112, the backing portion 114, or any combination thereof). In one embodiment, a size, shape, and/or location of the keying post 120 relative to the header 100 may be configured to correspond to a characteristic of at least one daughter card (e.g., as described herein with reference to daughter card 200). Although illustrated in FIG. 1A as comprising a curved upper surface, the keying post 120 may comprise any size, shape, or configuration associated with at least one daughter card within the scope of the present disclosure.

In one exemplary embodiment, the header 100 may comprise one or more shims 130. Each of the one or more shims 130 may be located at a surface of the body 110 of header 100. Although illustrated as being located at an area corresponding to backing portion 114, each of the one or more shims 130 may likewise be located at the base 112 of header 100, or any other surface thereof. Each of the at least one shims 130 may be configured, either alone or in combination, to manipulate a position of a daughter card (e.g., daughter card 200) when received by the header 100 in a receiving direction D. Although the at least one shim 130 is illustrated as having a wedge shape in FIGS. 1A-B, the shape, size, configuration, location, and/or characteristics of each of the at least one shims 130 may vary. In one embodiment, the shape, size, configuration, location, and/or characteristics of each shim 130 may be selected based on a thickness or overall size of a daughter card to be received by the header 100. For example, a distance which a shim 130 extends outward from a surface of the backing portion 114 may be configured to correspond to a thickness of a daughter card 200.

The header 100 may further comprise one or more pins 140. In one embodiment, the one or more pins 140 may be configured to be connected to the body 110 of the header 100. For example, at least one pin 140 may pass through the base 112 of the header 100 at a hole 150. In one embodiment, the holder 150 may be used to attach at least one pin 140 either at a time of manufacture of the header 100, or at a later time. For example, the header 100 may be configured to receive the pins 140 via a press fit method. In one embodiment, the at least one pin 140 may be press fit in accordance with a multispring press fit pin, an action pin press fit pin, an eye of the needle-style press fit pin, or any other pin and/or header configuration permitting a press fit. Assembly of the at least one pin 140 with header 100 by a press fit method may provide numerous benefits over traditional insert molding or other known processes. For example, by press fitting pins 140 with header 100, production time for the header 100 may be reduced and associated costs relative to insert molding may be reduced. In one embodiment, at least a portion of one or more pins 140 may be configured to connect to a daughter card (e.g., daughter card 200) via surface mounting, while opposing ends of the one or more pins 140 may be configured to connect to a main printed circuit board (PCB) 300 via corresponding pin through hole connects (e.g., through holes 310 illustrated at FIG. 3).

The distance between an inner surface of the backing portion 114 and the at least one pin 140 may form a gap G. In one embodiment, the daughter card 200 may be configured to be received within the gap G. The width of gap G may, in one embodiment, be predetermined to correspond to a width of a particular daughter card 200. A width of the shim 130 may form an offset O. In one embodiment, the offset O may be used to cause a proximal surface of the daughter card 200 to contact the backing portion 114 and a distal surface of the daughter card 200 to contact a surface of the at least one pin 140 when the daughter card is received in the gap G. The width of the offset O may be predetermined to correspond to a characteristic of a daughter card 200 in one embodiment. For example, in one embodiment, the width of gap G and offset O may be such that the difference between G and O is substantially equivalent to a width of a daughter card 200.

Figure 2A:
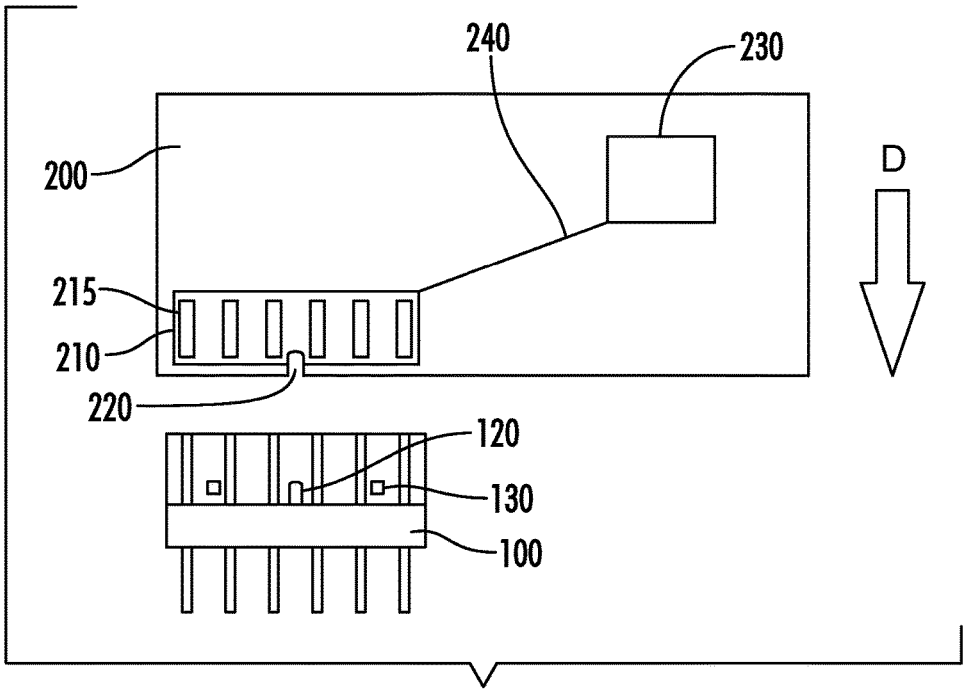
FIGS. 2A-B respectively illustrate front views of a daughter card and header apparatus before and after connection according to an exemplary embodiment.
Figure 2B:
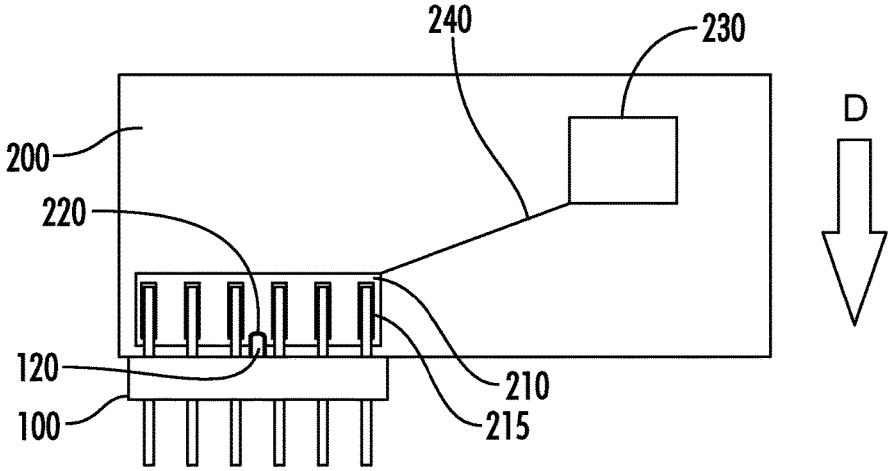
Figure 2C:
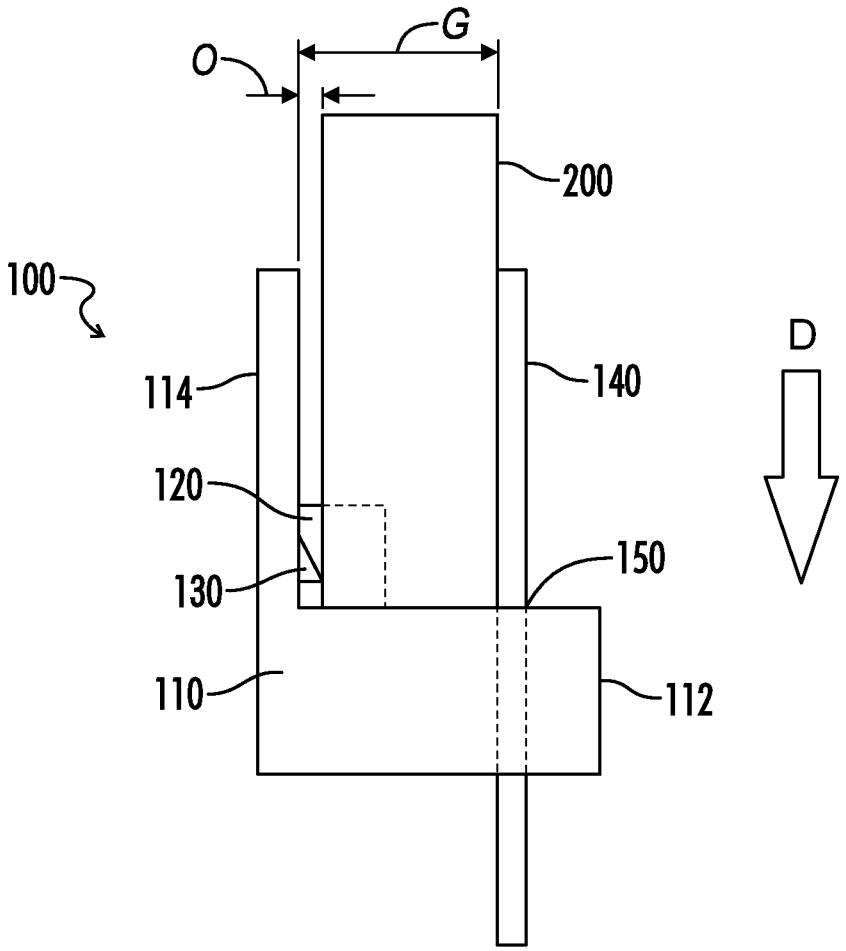
FIG. 2C illustrates a side view of the daughter card and header apparatus after connection according to an exemplary embodiment.

FIGS. 2A-C illustrate an exemplary relationship between a header 100 and daughter card 200 both before (FIG. 2A) and after (FIGS. 2B and 2C) receipt of the daughter card 200 within gap G in a receiving direction D. A daughter card 200 in accordance with the present disclosure is described with reference to FIGS. 2A-C. Daughter card 200 may comprise a circuit board. A daughter card 200 may comprise at least one component 230 connected to a mating surface 210 via a bus 240. Bus 240 may comprise, for example, a metallic conductor, a wire, or any other material capable of conveying information and/or signals to or from the at least one component 230 and the matching surface 210. The at least one component 230 may comprise any component, connector, or element configured to transmit or receive information to or from at least one conductor 215 of the mating surface 210. For example, in one embodiment the at least one component 230 may comprise a processor configured to transmit and receive signals using at least one conductor 215 of the mating surface 210. The at least one component 230 may, in one embodiment, comprise a surface mounted component. The at least one component 230 may be configured to be connected to the daughter card 200 by a soldering method, for example a reflow soldering method.

The daughter card 200 may further comprise at least one notch 220. The at least one notch may be configured to correspond to at least one keying post 120 of the header 100. In one embodiment, the notch 220 and keying post 120 may be placed in contact with one another when the daughter card 200 is received by the header 100 in the receiving direction D. Although illustrated in FIGS. 2A-C as containing only a single pairing of notch 220 and keying post 120, it should be understood that a plurality of pairs of notches 220 and keying posts 120 may be formed on the daughter card 200 and header 100 within the spirit and scope of the present disclosure. For example, a use of multiple notch 220 and keying post 120 pairs for connection may result in a more structurally rigid configuration of the daughter card 200 and header 100 after attachment, and may reduce an amount of movement of the daughter card 200 and header 100 to one another while connected at the notch 220 and keying post 120 pair(s).

At least one pin 140 of the header 100 may be placed in contact with at least one conductor 215 of the mating surface 210 of daughter card 200 when the daughter card is received by the header 100 in the receiving direction D. In one embodiment, the at least one conductor 215 may be placed in contact with the at least one pin 140 (e.g., by means of the shim 130), which may shift at least a portion of the daughter card 200 in a direction of the at least one pin 140 when the daughter card 200 is moved in the receiving direction D. Thus, the header 100 may be surface mounted to the daughter card 200 according to an exemplary embodiment. When surface mounting the header 100 to the daughter card 200, the at least one pin 140 of the header 100 may be soldered to at least one conductor 215 of the daughter card 200.

Unlike existing PCB/daughter card connectors, a daughter card 200 in accordance with the present disclosure may be implemented without requiring through hole connectors at the daughter card 200 for an associated header 100 (e.g., because the header 100 may be surface mounted to the daughter card 200). This configuration may reduce time and costs associated with manufacturing the daughter card 200. For example, by not requiring through hole connectors for connecting to the header 100, the daughter card 200 of the present disclosure may permit surface mounted components (e.g., component 230 and header 100) to be mounted to the daughter card 200 using only a reflow soldering method, as opposed to requiring both a reflow soldering method and a wave soldering method if through hole connectors are used. In one exemplary embodiment, a single reflow soldering method may be used to simultaneously both attach components 230 to daughter card 200 and attach header 100 to daughter card 200.

As illustrated by FIG. 2C, the offset O associated with a shim 130 may be such that a daughter card 200 may be placed in contact with the shim 130 at a proximal surface while a distal surface of the daughter card 200 is placed in contact with the at least one pin 140. In one embodiment, the at least one pin 140 may be soldered to the daughter card 200 to form an electrical connection therebetween.

Figure 3A:
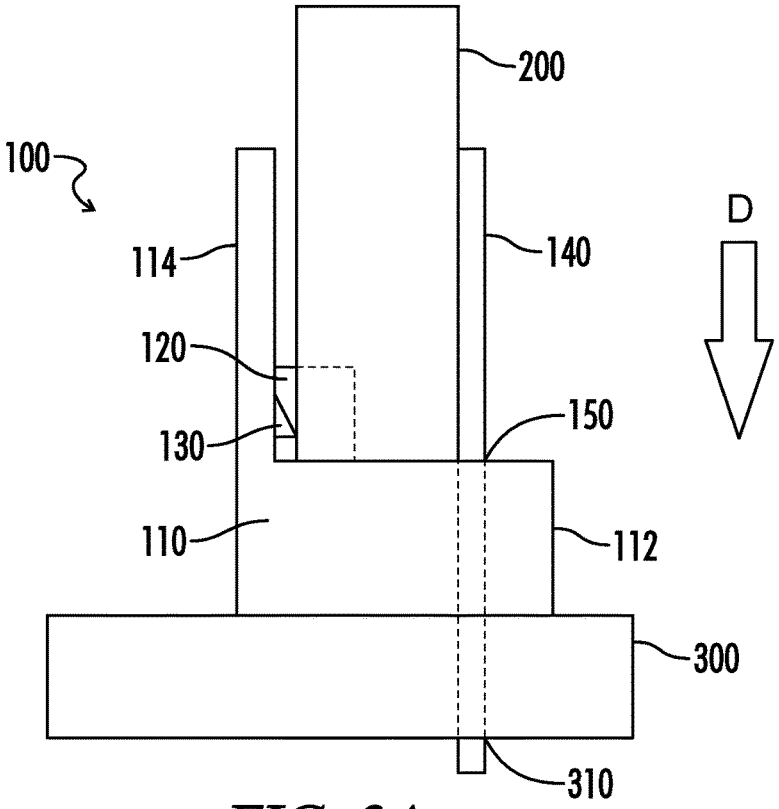
FIGS. 3A-B respectively illustrate a side view and a perspective view of a header, a daughter card, and a circuit board according to an exemplary embodiment.
Figure 3B:
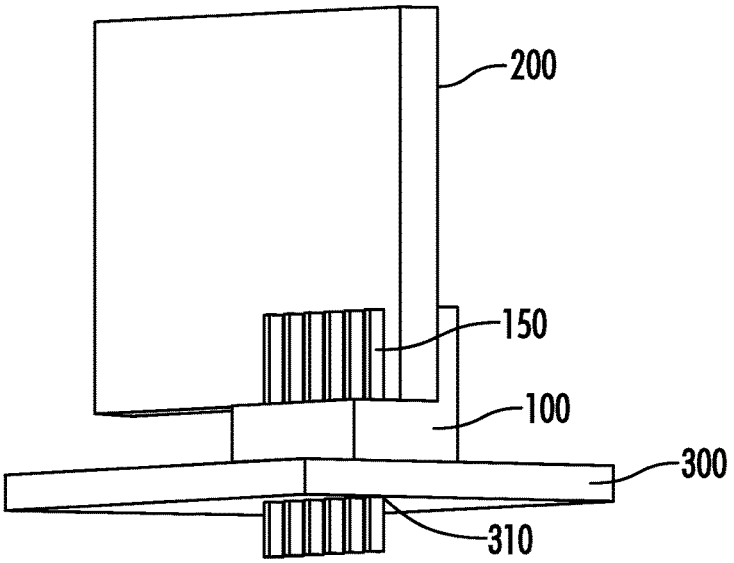
Figure 4:
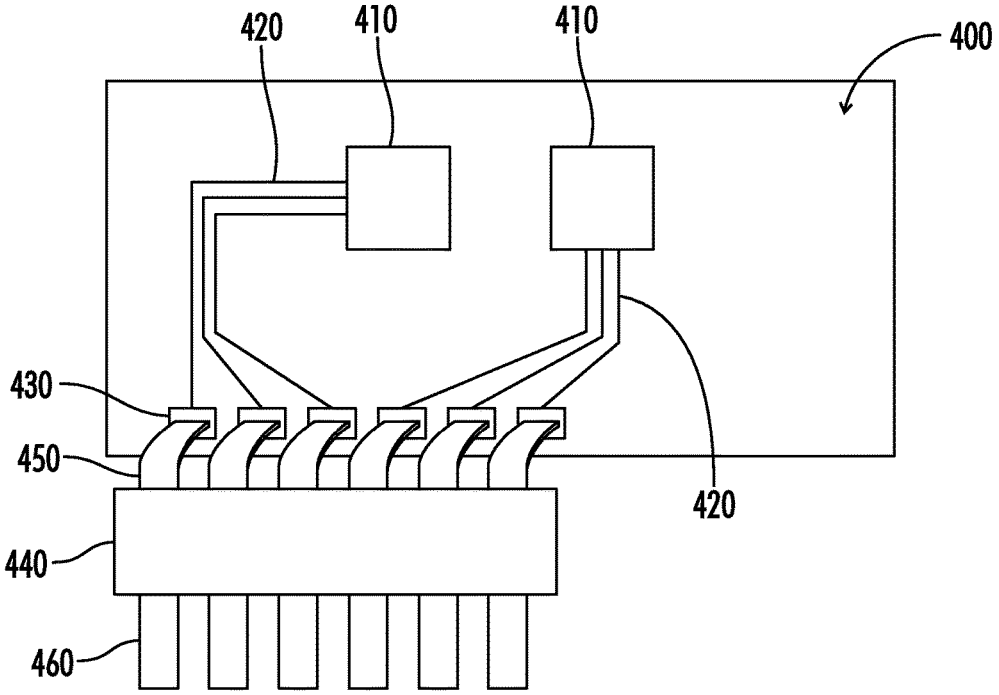
FIG. 4 (PRIOR ART)
FIG. 4 is a front view of a daughter card connected to a connector according to the related art.

FIGS. 3A-B respectively illustrate a side view and a perspective view of a header 100, daughter card 200, and main PCB 300 in accordance with an embodiment of the present disclosure. In the embodiment illustrated by FIGS. 3A-B, the header 100 and daughter card 200 may be connected as previously described with reference to FIGS. 2A-C. Either before or after the daughter card 200 is connected to the header 100, a main PCB 300 may be connected to the header 100 using pins 140. In one embodiment, the main PCB 300 may be connected to at least one pin 140 via pin through holes associated with the main PCB. In this embodiment, the main PCB 300 may be connected to the at least one pin 140 of the header 100 by means of wave soldering at or near an exit 310 of the main PCB where at least a portion of the at least one pin 140 extends outwardly from a surface of the main PCB 300. Alternatively or in addition to wave soldering, a press fit may be formed between the at least one pin 140 and main PCB 300. Although described as being soldered at exit 310, the main PCB 300 may be connected to the at least one pin 140 via other fastening means, such as press fitting, or any other fastening means capable of permitting an electrical connection to be formed between the main PCB 300 and at least one pin 140.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. The phrase "in one embodiment," as used herein does not necessarily refer to the same embodiment, although it may.

The term "circuit" means at least either a single component or a multiplicity of components, either active and/or passive, that are coupled together to provide a desired function. Terms such as "wire," "wiring," "line," "signal," "conductor," and "bus" may be used to refer to any known structure, construction, arrangement, technique, method and/or process for physically transferring a signal from one point in a circuit to another. Also, unless indicated otherwise from the context of its use herein, the terms "known," "fixed," "given," "certain" and "predetermined" generally refer to a value, quantity, parameter, constraint, condition, state, process, procedure, method, practice, or combination thereof that is, in theory, variable, but is typically set in advance and not varied thereafter when in use.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. A header apparatus for providing electrical connection between a daughter card and a printed circuit board, the header apparatus comprising:

a body comprising:

a base; and a backing portion extending outwardly from the base;

at least one pin extending through the base in a direction substantially parallel to the backing portion;

a gap defined between opposing surfaces of the backing portion and the at least one pin, wherein the header is configured to receive at least a portion of the daughter card within the gap to connect the header and the daughter card; and at least one shim extending outwardly from the backing portion towards the at least one pin, wherein the at least one shim is configured to cause at least a portion of the daughter card to be placed in contact with a surface of the at least one pin when the at least a portion of the daughter card is received by the header apparatus.

2. The header apparatus of claim 1, wherein the at least one pin is configured to attach to the daughter card by a mounting process used to attach surface mount components of the daughter card to the daughter card.

3. The header apparatus of claim 2, wherein the mounting process is includes a reflow soldering process.

4. The header apparatus of claim 1, wherein the header apparatus is configured to attach to a main printed circuit board (PCB) at an opposing end of the at least one pin from the daughter card.

5. The header apparatus of claim 1, wherein the header apparatus is configured to attach to a main printed circuit board (PCB) by inserting at least a portion of the at least one pin into a through-hole connector of the main PCB.

6. The header apparatus of claim 1, wherein the header apparatus further comprises a keying post extending outwardly from the backing portion, the keying post being configured to correspond to a characteristic of the daughter card.

7. The header apparatus of claim 6, wherein the keying post is configured to align the at least one pin with the daughter card for connecting to the header apparatus and the daughter card.

8. The header apparatus of claim 6, wherein the characteristic of the daughter card is at least one of a size, a shape, and a location of an element of the daughter card corresponding to the keying post.

9. The header apparatus of claim 1, wherein the at least one pin is configured to be inserted through a hole formed during a molding process of the header apparatus.

10. The header apparatus of claim 9, wherein the at least one pin is configured to connect to the header apparatus according to a press fit method.

11. A daughter card having a header connected thereto, the daughter card being configured to connect to a main printed circuit board (PCB), the daughter card comprising:

the header comprising a body comprising a base, and a backing portion extending outwardly from the base, at least one pin extending through the base in a direction substantially parallel to the backing portion, a gap defined between opposing surfaces of the backing portion and the at least one pin, wherein the header is configured to receive at least a portion of the daughter card within the gap to connect the header and the daughter card, and at least one shim extending outwardly from the backing portion towards the at least one pin, wherein the at least one shim is configured to cause at least a portion of the daughter card to be placed in contact with a surface of the at least one pin when the at least a portion of the daughter card is received by the header; and a circuit board comprising:

at least one component, a bus, and a connection interface communicatively coupled to the at least one component via the bus, wherein the connection interface is connected to the header.

12. The daughter card of claim 11, wherein the at least one component is a surface mounted component, and wherein the at least one pin is configured to attach to the daughter card by a mounting process used to attach the at least one component to the daughter card.

13. The daughter card of claim 12, wherein the mounting process is a reflow soldering process.

14. The daughter card of claim 11, wherein after the header is attached to the daughter card, the header is configured to attach to the main PCB at an opposing end of the at least one pin from the daughter card to interconnect the daughter card and the main PCB.

15. The daughter card of claim 11, wherein the header is configured to attach to the main PCB by inserting at least a portion of the at least one pin into a through-hole connector of the main PCB.

16. The daughter card of claim 11, wherein the header further comprises a keying post configured to correspond to a characteristic of the circuit board.

17. The daughter card of claim 16, wherein the keying post is configured to align the at least one pin with the daughter card for connecting to the header and the daughter card.

* * * * *